US009559429B2

(12) United States Patent
Fang

(10) Patent No.: US 9,559,429 B2
(45) Date of Patent: Jan. 31, 2017

(54) FEEDING NETWORK FOR BASE STATION ANTENNA

(71) Applicant: TONGYU COMMUNICATION INC., Zhongshan (CN)

(72) Inventor: Fengming Fang, Zhongshan (CN)

(73) Assignee: TONGYU COMMUNICATION INC., Zhongshan (CN)

( * ) Notice: Subject to any disclaimer, the term of this patent is extended or adjusted under 35 U.S.C. 154(b) by 0 days.

(21) Appl. No.: 14/503,900

(22) Filed: Oct. 1, 2014

(65) Prior Publication Data

US 2015/0155609 A1 Jun. 4, 2015

Related U.S. Application Data

(63) Continuation of application No. PCT/CN2013/088354, filed on Dec. 2, 2013.

(51) Int. Cl.
*H01Q 21/00* (2006.01)
*H01P 1/18* (2006.01)
(Continued)

(52) U.S. Cl.
CPC ..... *H01Q 21/0075* (2013.01); *H01P 1/182* (2013.01); *H01P 1/183* (2013.01);
(Continued)

(58) Field of Classification Search
CPC ..... H01P 1/182; H01P 1/184; H01P 5/12; H01P 1/183; H01P 3/084; H01Q 3/32; H01Q 21/0075
(Continued)

(56) References Cited

U.S. PATENT DOCUMENTS 2,502,359 A 3/1950 Wheeler
3,493,898 A 2/1970 Ward
(Continued)

FOREIGN PATENT DOCUMENTS

CN 101707271 A 5/2010
CN 102157767 * 8/2011
(Continued)

OTHER PUBLICATIONS

Extended European Search Report dated Feb. 8, 2016 in corresponding European Application No. 13898577.5.
(Continued)

*Primary Examiner* — Benny Lee
*Assistant Examiner* — Jorge Salazar, Jr.
(74) *Attorney, Agent, or Firm* — Finnegan, Henderson, Farabow, Garrett & Dunner, LLP

(57) ABSTRACT

The present disclosure relates to feeding networks for base station antenna. Embodiments of the disclosure may comprise first and second phase shifters, and a 3-way power divider, including an input terminal, a first output terminal for feeding a first unit, a second output terminal connecting to the first phase shifter, and a third output terminal connecting to the second phase shifter. The feeding network may also comprise a first 2-way power divider, including an input terminal connecting to the first phase shifter, a first output terminal for feeding a second unit, and a second output terminal for cascading a third phase shifter. In addition, the feeding network may comprise a second 2-way power divider, including an input terminal connecting to the second phase shifter, a first output terminal for feeding a third unit, and a second output terminal for cascading a fourth phase shifter.

9 Claims, 8 Drawing Sheets

(51) Int. Cl.

| | |
|---|---|
| ***H01P 3/08*** | (2006.01) |
| ***H01P 5/12*** | (2006.01) |
| ***H01Q 3/32*** | (2006.01) |

(52) U.S. Cl.
CPC ..... *H01P 1/184* (2013.01); *H01P 3/084* (2013.01); *H01P 5/12* (2013.01); *H01Q 3/32* (2013.01)

(58) Field of Classification Search
USPC ..... 333/125, 126, 128, 134, 135, 136, 137, 333/156–161; 343/853
See application file for complete search history.

(56) References Cited

U.S. PATENT DOCUMENTS

| | | | | |
|---|---|---|---|---|
| 5,905,462 | A | 5/1999 | Hampel | |
| 2007/0046393 | A1* | 3/2007 | Quan et al. | 333/128 |
| 2011/0109507 | A1* | 5/2011 | Warnick | H01Q 21/0025 342/368 |

FOREIGN PATENT DOCUMENTS

| | | | |
|---|---|---|---|
| EP | 2485322 | A1 | 8/2012 |
| GB | 2238665 | A | 6/1991 |

OTHER PUBLICATIONS

Communication pursuant to Rules 70(2) and 70a(2) EPC notifying deadline for responding to European Search Report in corresponding European Application No. 13898577.5, dated Feb. 25, 2016.

* cited by examiner

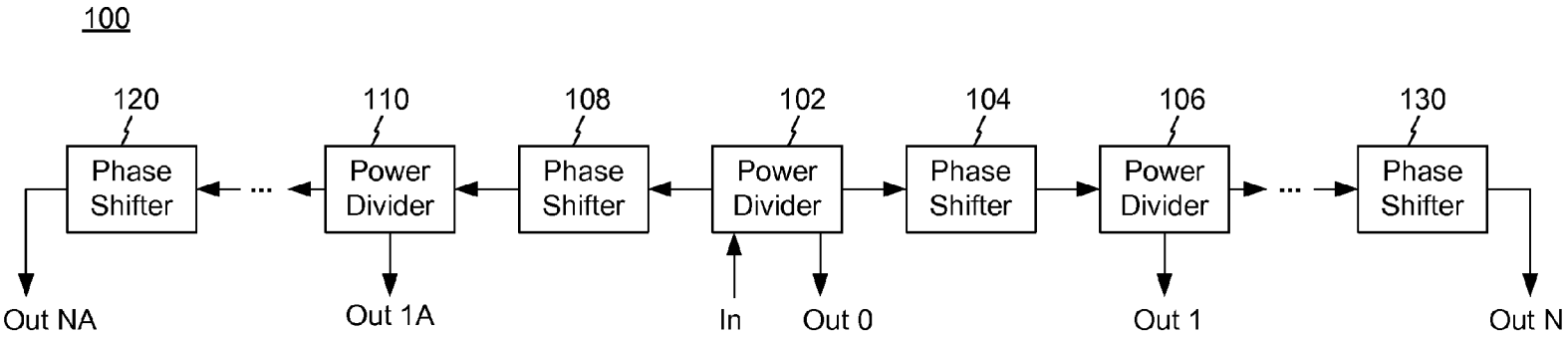
FIG. 1
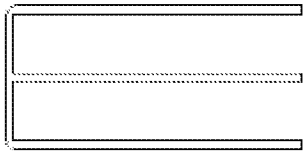
FIG. 2A
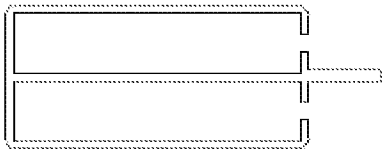
FIG. 2B
FIG. 2C
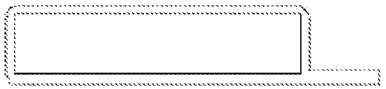
FIG. 2D
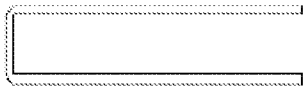
FIG. 2E
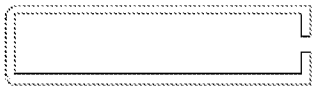
FIG. 2F

FEEDING NETWORK FOR BASE STATION ANTENNA

CROSS REFERENCE TO RELATED APPLICATION

This application is a continuation of International Application No. PCT/CN2013/088354, filed Dec. 2, 2013, the entire content of which is incorporated herein by reference.

TECHNICAL FIELD

This disclosure relates generally to telecommunication technologies. More specifically, it relates to a feeding network used for electrically adjustable base station antenna.

BACKGROUND

With the advance of mobile communication technology, the requirements for electrical and mechanical performance of a base station antenna become higher and higher. High performance and miniaturization become a trend in the development of base station antenna, such as a constant pursuing of larger electrical declination, higher efficiency, wider bandwidth, and smaller volume. This trend in turn requires high-performance feeding network for base station antenna.

In order to obtain relatively large phase changes, existing phase shifting devices assume a large footprint, resulting in a complex feeding network structure and reduced electrical performance and consistency. Therefore, it is desirable to develop a new feeding network for base-station antenna with flexible design of power division ratio, compact structure, stable performance, wide working band, good consistence, low power loss, simple structure, small volume, reduced cost and convenience for mass production.

SUMMARY

According to the present disclosure, there is provided a feeding network for base station antenna. The feeding network may comprise first and second phase shifters, and a 3-way power divider, including an input terminal for connecting to a feeding port, a first output terminal for feeding a first unit of the base station antenna, a second output terminal connecting to the first phase shifter, and a third output terminal connecting to the second phase shifter. The feeding network may also comprise a first 2-way power divider, including an input terminal connecting to the first phase shifter, a first output terminal for feeding a second unit of the base station antenna, and a second output terminal for cascading a third phase shifter. In addition, the feeding network may comprise a second 2-way power divider, including an input terminal connecting to the second phase shifter, a first output terminal for feeding a third unit of the base station antenna, and a second output terminal for cascading a fourth phase shifter.

In some embodiments, various power dividers and phase shifters may cascade in a distributed way to achieve flexible design of power division ratio, stable performance and relatively low power loss. Such distribution may further optimize the phase shifters and power dividers as well as the general structure of the feeding network, achieving a compact structure of the feeding network, relatively small dimensions, ease of processing and reduced cost. The number of output terminals of the feeding network can be easily expanded, meeting the demand for wide-band feeding network in the application of electrically adjustable base station antenna. The phase shifters may be implemented based on the nest coupling principle of metal tube and therefore can achieve excellent consistency, flexible design of power division ratio, stable performance and relatively low power loss.

In some embodiments, various functional components may be assembled in a narrow and long metal housing that is integrally formed. Feeding ports may be distributed along the long side of the metal housing. Functional assemblies may also be placed inside the housing, overcoming the deficiencies such as complicated structure, too many welding spots and high power loss. The compact structure of the metal housing may reduce signal leakage and avoid resonance points.

Additional objects and advantages of the present disclosure will be set forth in part in the following detailed description, and in part will be obvious from the description, or may be learned by practice of the present disclosure. The objects and advantages of the present disclosure will be realized and attained by means of the elements and combinations particularly pointed out in the appended claims.

It is to be understood that the foregoing general description and the following detailed description are exemplary and explanatory only, and are not restrictive of the invention, as claimed.

BRIEF DESCRIPTION OF THE DRAWINGS

The accompanying drawings, which constitute a part of this specification, illustrate several embodiments and, together with the description, serve to explain the disclosed principles.

FIG. 1 is a schematic diagram of an exemplary feeding network, according to some embodiments of the present disclosure.

FIGS. 2A-2F illustrate exemplary cross-sectional shapes of some exemplary metal housings, according to some embodiments of the present disclosure.

DETAILED DESCRIPTION

Figure 3B:
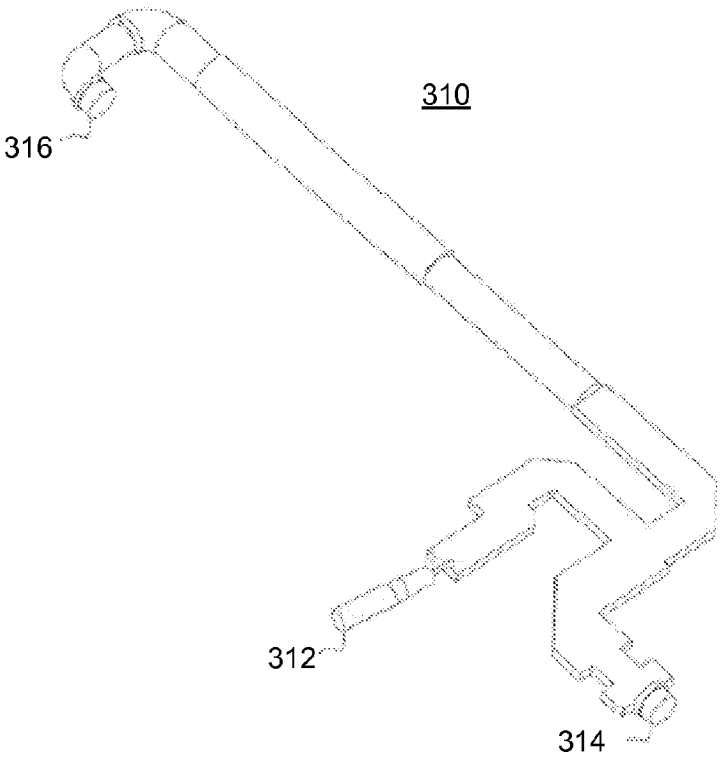
FIGS. 3A-3B are structural diagrams of exemplary power dividers, according to some embodiments of the present disclosure.

Exemplary embodiments are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. Also, the words "comprising," "having," "containing," and "including," and other similar forms are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise.

FIG. 1 is a schematic diagram of an exemplary feeding network 100. Referring to FIG. 1, the feeding network 100 may include a 3-way power divider 102. Power input from a feed port In is divided, for example, equally into 3 routes through 3-way power divider 102. One route may be used to feed a central unit of an antenna array, and the other two output terminals may be connected with a phase shifter 108 on the left and a phase shifter 104 on the right, respectively. Adjacent phase shifters may be cascaded through, for example, 2-way power dividers 106 or 110. Power dividers 106 and 110 may then feed units on the left and right sides of the antenna array, respectively. For example, an output terminal Out 0 of power divider 102 may feed the central unit, an output terminal Out 1 of power divider 106 may feed a unit on the right, and output terminal Out 1A of power divider 110 may feed a unit on the left. In either side of 3-way power divider 102, multiple phase shifters and 2-way power dividers may be provided. For example, in FIG. 1, N phase shifters and N−1 2-way power dividers are provided on the right side, and NA phase shifters and NA−1 2-way power dividers are provided on the left side. The output terminal of a present phase shifter may be connected to the input terminal of a next power divider. One output terminal of the 2-way power divider, e.g., power divider 106 or 110, may be used as an output terminal of the feeding network 100, e.g., Out 1 or Out 1A, and the other output terminal of the 2-way power divider may be connected to the input terminal of the next phase shifter. A power division ratio can also be set as required. The various phase shifters may be identical, and phase shifts of the corresponding output terminals on the left and right sides are opposite when a sliding rod moves along a line to form stepped phase distribution and to control a declination angle of the direction diagram in the vertical plane. In some embodiments, the various phase shifters may be identical to apply an equal-difference phase change.

In some embodiments, the phase shifters and the power dividers of the feeding network 100 may be placed in an integrally formed metal housing, and various feeding ports may be distributed along a long side of the metal housing. Various functional components may be assembled inside the narrow, long metal housing. The various feeding ports being distributed along the long side of the metal housing and the functional assemblies being placed inside the metal housing can simplify the overall structure of the feeding network 100, reduce a number of welding spots, and lower power loss.

FIGS. 2A-2F illustrate exemplary cross-sectional shapes of some exemplary metal housings. For example, FIG. 2D shows a single rectangular shape. FIG. 2E shows a one-side-opened single rectangular shape. FIG. 2F shows an one-side-partially-opened single rectangular shape. FIG. 2A shows an up-down dual rectangular shape. FIG. 2C shows an up-down one-side-opened dual rectangular shape. FIG. 2B shows an up-down one-side-partially-opened dual rectangular shape. Other shapes, such as left-right dual rectangular shape or left-right one-side-opened dual rectangular shape may also be used. In some embodiments, a multi-cavity housing formed by combing two or more of the above may be used.

Figure 3A:
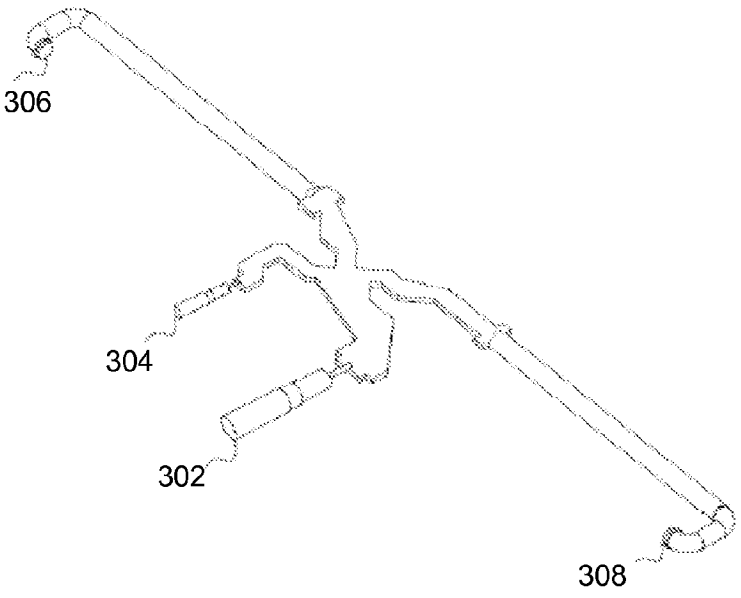

FIG. 3A is a structural diagram of an exemplary 3-way power divider 300. Power divider 300 may include an air strip line in branch form. The strip line may be of flat, round, square, or other shape or combination thereof. In FIG. 3A, a terminal 302 is an input terminal, and terminals 304, 306, and 308 are output terminals.

FIG. 3B is a structural diagram of an exemplary 2-way power divider 310. Power divider 310 may include an air strip line in branch form. The strip line may be of flat, round, square, or other shapes or combination thereof. In FIG. 3B, a terminal 312 is an input terminal, and terminals 314 and 316 are output terminals.

Figure 4:
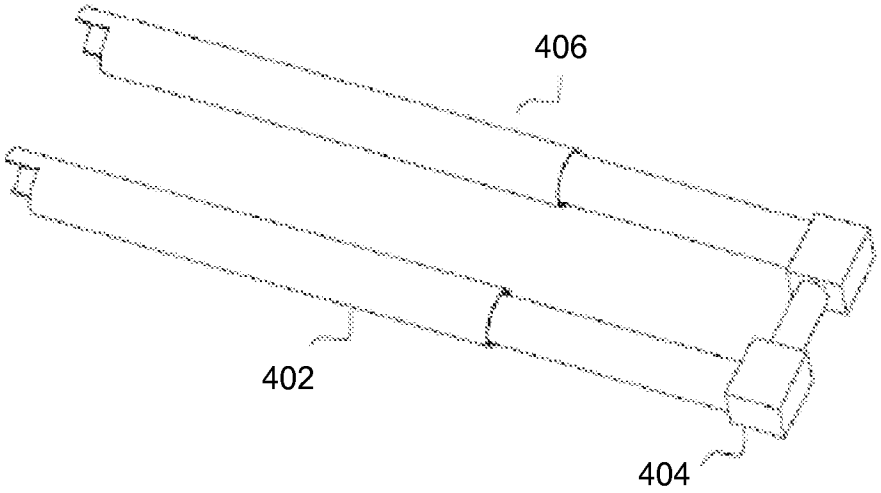
FIG. 4 is a structural diagram of an exemplary phase shifter, according to some embodiments of the present disclosure.

FIG. 4 is a structural diagram of an exemplary phase shifter 400. Phase shifter 400 may include a deformed strip line. Phase shifter 400 may include fixed transmission lines 402 and 406. Fixed transmission lines 402 and 406 may include hollow round metal tubes. Phase shifter 400 may also include a sliding transmission line 404. Transmission line 404 may include a moveable U-shaped metal rod. Sliding transmission line 404 may be coated with an insulation medium layer on the surface. Sliding transmission line 404 may be inserted into fixed transmission lines 402 and 406. Phase adjustment may be achieved by sliding transmission line 404 to change an electrical length of the transmission line.

In some embodiments, a single-row feeding structure can be combined with one or more other feeding structure to form a multi-level feeding network. Adjacent levels may be connected through tiling and/or laminating. The resulting multi-level feeding network may provide more output terminals.

Figure 5:
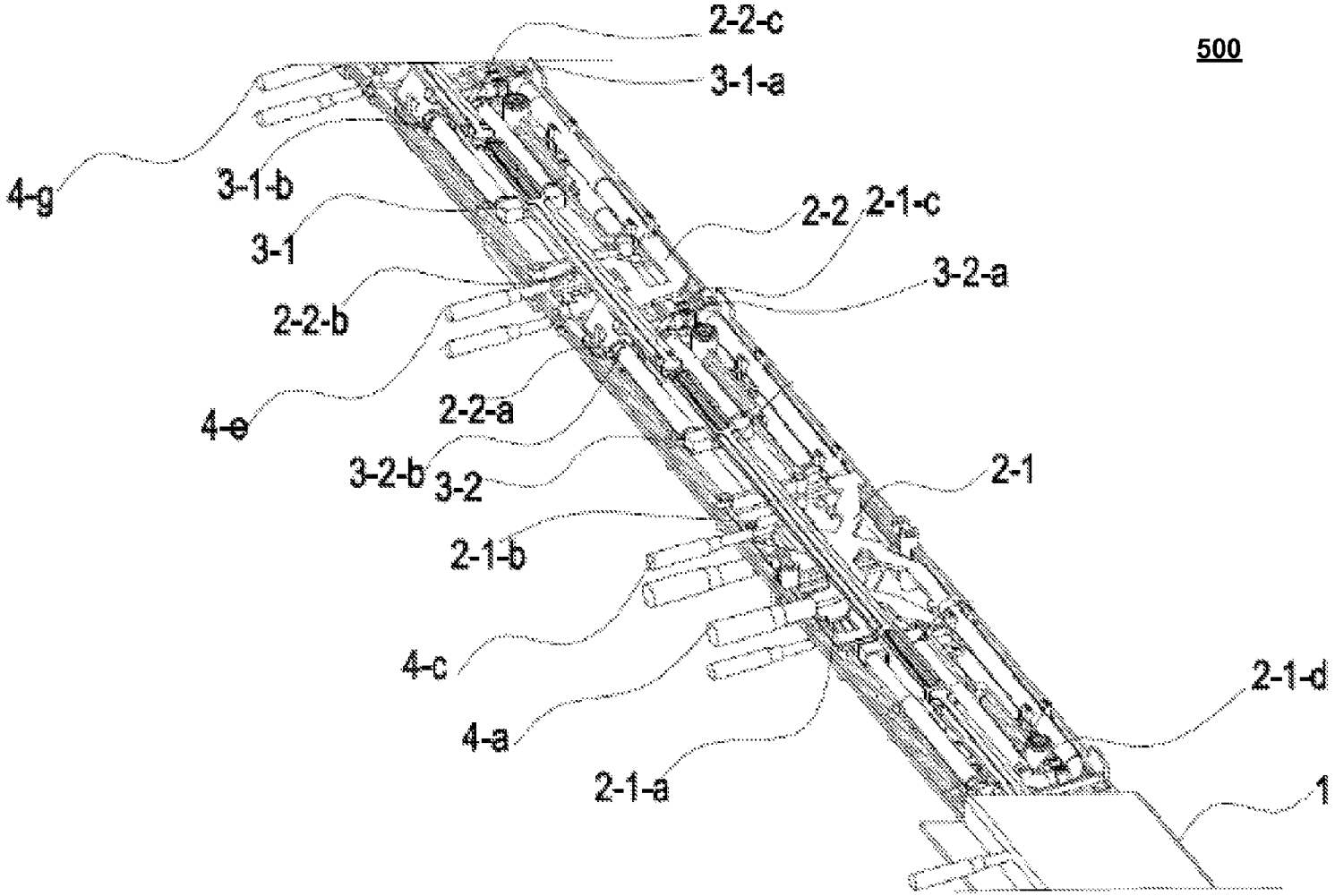
FIG. 5 is a structural diagram of an exemplary feeding network, according to some embodiments of the present disclosure.

FIG. 5 is a structural diagram of an exemplary feeding network comprising a laminated 2-in-8-out feeding network 500. In the example, each layer includes 7 power dividers and 8 phase shifters, constituting a 1-in-9-out electrical feeding system (only part of this system is shown in FIG. 5). In FIG. 5, a power divider 2-1 is an input power divider and a power divider 2-2 connects phase shifters 3-1 and 3-2. Power dividers 2-1, 2-2 and phase shifters 3-1, 3-2 are all assembled in a metal housing 1. In the upper layer, coaxial cables can be used to input a signal from a terminal 4-*a* to an input terminal 2-1-*a* of power divider 2-1. The input signal may be divided into three routes respectively corresponding to three output terminals 2-1-*b*, 2-1-*c*, and 2-1-*d* of power divider 2-1. The route corresponding to output terminal 2-1-*b* may connect a coaxial cable 4-*c* and may be used as an output terminal. The route corresponding to output terminal 2-1-*c* may be connected to an input terminal 3-2-*a* of phase shifter 3-2. After phase shifting, the signal may pass through an output terminal 3-2-*b* of phase shifter 3-2 to an input terminal 2-2-*a* of power divider 2-2. Power divider 2-2 may further divide the input signal into two routes respectively corresponding to two output terminals 2-2-*b* and 2-2-*c* of power divider 2-2. The route corresponding to output terminal 2-2-*b* may connect to a coaxial cable 4-*e* as an output of the feeding network. The route corresponding to output terminal 2-2-*c* may be connected to an input terminal 3-1-*a* of phase shifter 3-1. After phase shifting, the signal may pass through an output terminal 3-1-*b* of phase shifter 3-1 to a coaxial cable 4-*g* as an output. In the lower layer, the connection is similar to the upper layer. With the feeding network shown in FIG. 5, equal difference phase change can be obtained when the phase shifters change the phase of the signal as a result of the sliding transmission line being slid relative to the fixed transmission line.

Figure 6:
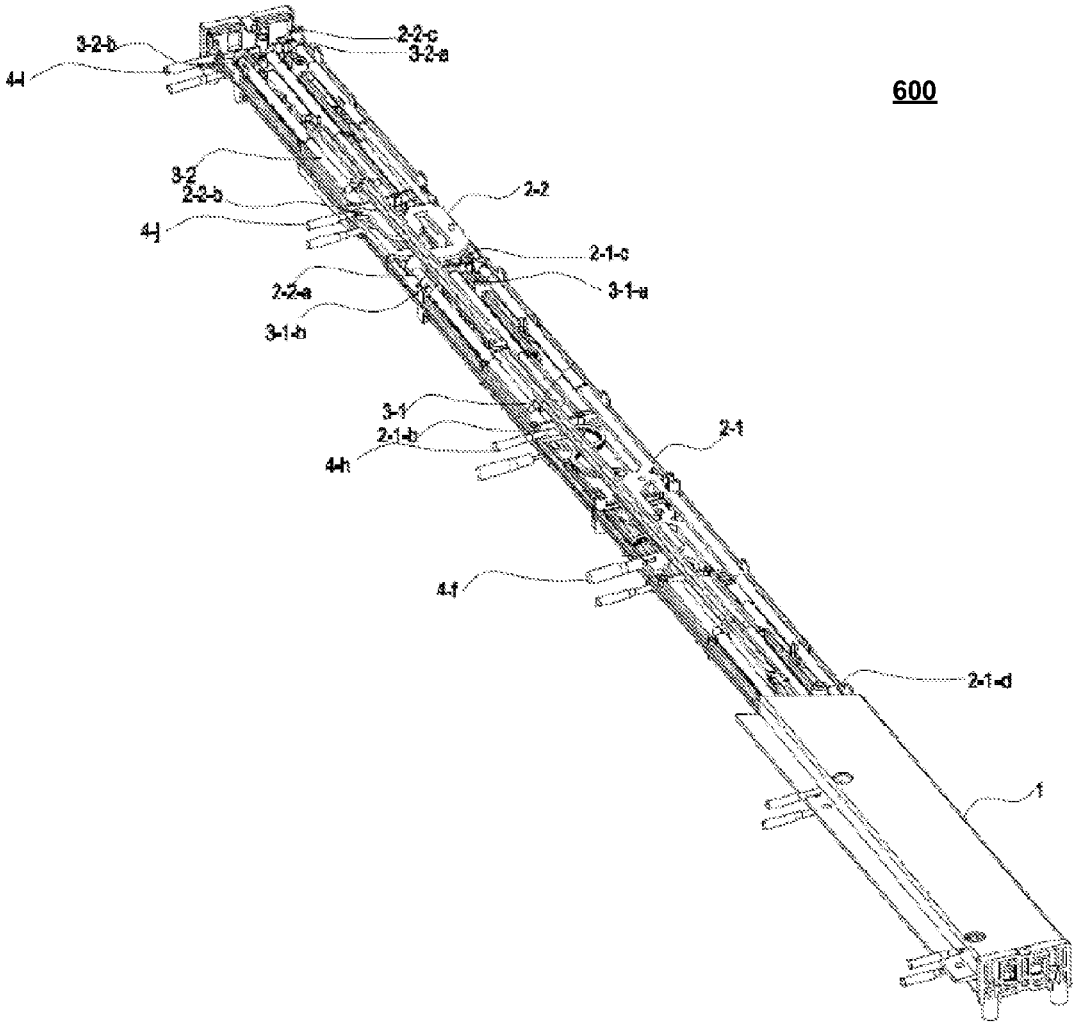
FIG. 6 is a structural diagram of an exemplary feeding network, according to some embodiments of the present disclosure

FIG. 6 is a structural diagram of an exemplary feeding network 600 comprising a two-layer 2-in-10-out feeding network. Each layer includes 3 power dividers and 4 phase shifters, constituting a 1-input-5-output electrical feeding system. In FIG. 6, reference number 2-1 is an input 3-way power divider and reference number 2-2 is a 2-way power divider. 2-way power divider 2-2 connects phase shifters 3-1 and 3-2. In the upper layer, on the left side of the feeding network 600, a signal can be input from a coaxial input terminal 4-*f*. Through power divider 2-1, the signal can be divided into 3 routes respectively corresponding to three output terminals 2-1-*b*, 2-1-*c*, and 2-1-*d* of power divider 2-1. The route corresponding to output terminal 2-1-*b* may connect to the conductor inside the coaxial wire, forming an output terminal 4-*h*. The route corresponding to output terminal 2-1-*c* may be connected to an input terminal 3-1-*a* of phase shifter 3-1. After phase shifting, an output terminal 3-1-*b* of phase shifter 3-1 may be connected to an input terminal 2-2-*a* of power divider 2-2. The signal may be divided into 2 routes respectively corresponding to two output terminals 2-2-*b* and 2-2-*c* of power divider 2-2. The route corresponding to output terminal 2-2-*b* may connect to a conductor inside the coaxial wire, forming an output terminal 4-*j*. The route corresponding to output terminal 2-2-*c* may connect to an input terminal 3-2-*a* of phase shifter 3-2. After phase shifting, an output terminal 3-2-*b* of phase shifter 3-2 may be connected to a conductor inside the coaxial wire, forming an output terminal 4-I. On the right side of the upper layer and the lower layer, the feeding network structures are similar to that in the upper layer left side.

Figure 7:
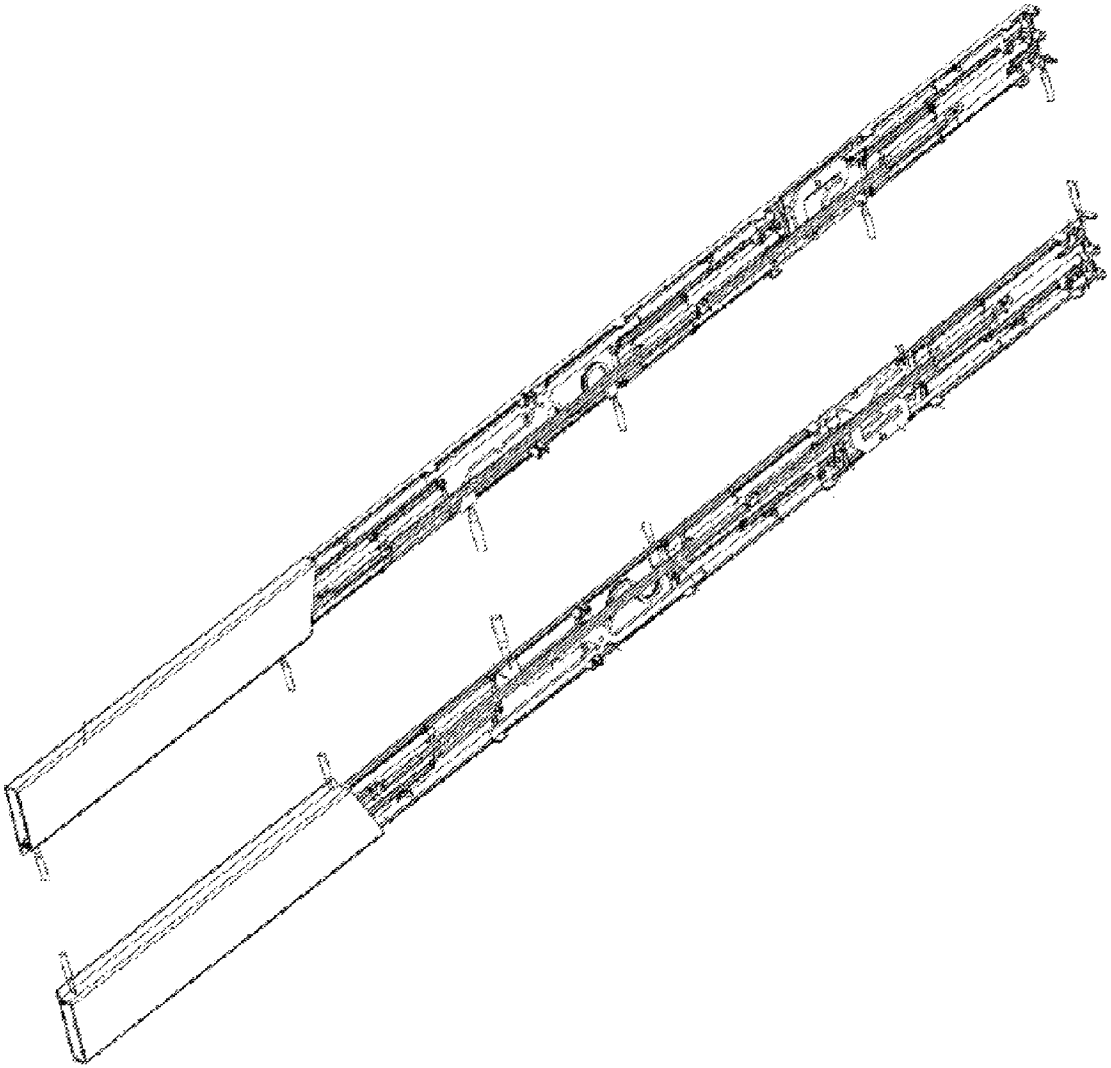
FIG. 7 is a structural diagram of an exemplary feeding network, according to some embodiments of the present disclosure.

FIG. 7 is a structural diagram of an exemplary feeding network comprising a 2-in-10-out feeding network through tiling. The connection is similar to that shown in FIG. 5 except that the arrangement of the two groups of sub-networks is different.

Figure 8A:
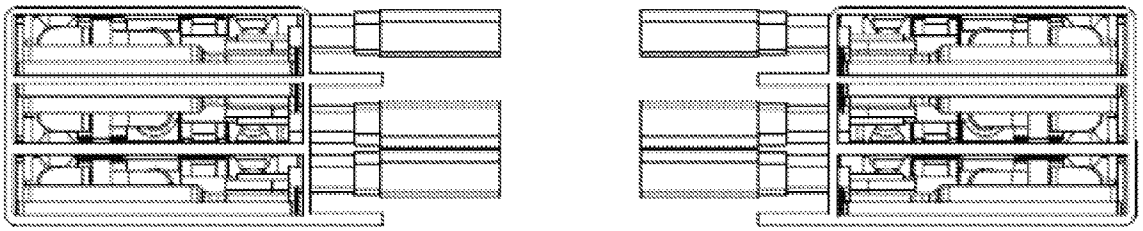
FIGS. 8A-8D show diagrams of exemplary single-layer, dual-layer, tri-layer, and multi-layer combination modes of exemplary feeding networks, respectively, according to some embodiments of the present disclosure.
Figure 8B:
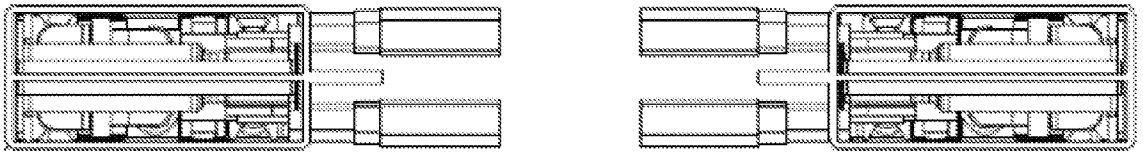
Figure 8C:
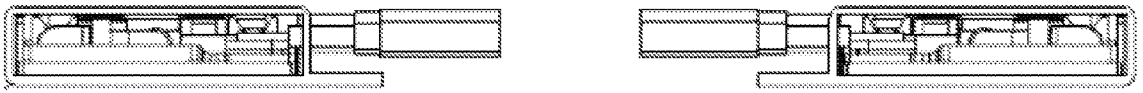
Figure 8D:
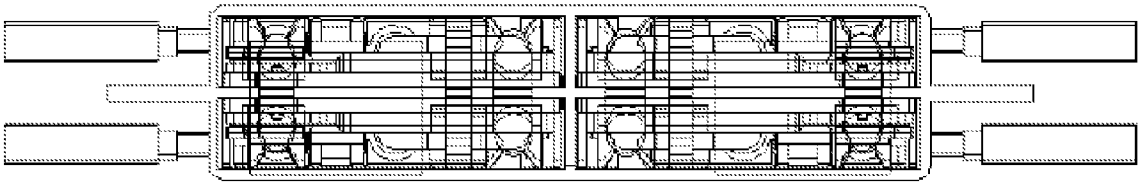

FIGS. 8A-8D shows diagrams of exemplary single-layer, dual-layer, tri-layer and multi-layer combination modes of feeding networks. FIG. 8A shows a tri-layer combination mode. FIG. 8B shows a dual-layer combination mode. FIG. 8C shows a single-layer combination mode. FIG. 8D shows a multi-layer combination mode. The exemplary modes in FIGS. 8A-8D show that a laminated feeding structure can form a feeding network having more ports than a single feeding structure. In addition to laminating, the number of ports of the feeding network can be further increased through tiling.

Figure 9:
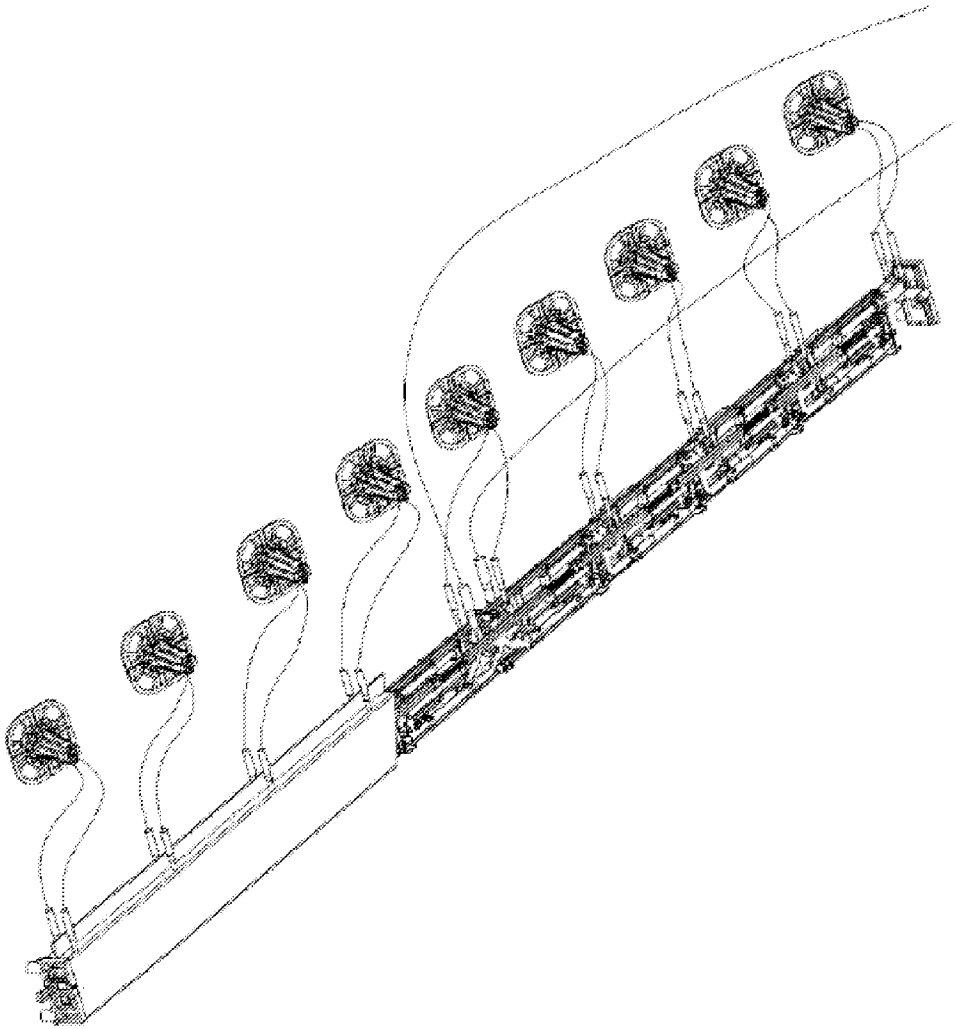
FIG. 9 illustrates a structural diagram of an exemplary connection configuration between a feeding network and antenna units, according to some embodiments of the present disclosure.

FIG. 9 illustrates a structural diagram of an exemplary connection configuration between a feeding network and antenna units.

The specification describes feeding networks for base station antenna. The illustrated steps are set out to explain the exemplary embodiments shown, and it should be anticipated that ongoing technological development will change the manner in which particular functions are performed. Thus, these examples are presented herein for purposes of illustration, and not limitation. For example, steps or processes disclosed herein are not limited to being performed in the order described, but may be performed in any order, and some steps may be omitted, consistent with disclosed embodiments. Further, the boundaries of the functional building blocks have been arbitrarily defined herein for the convenience of the description. Alternative boundaries can be defined so long as the specified functions and relationships thereof are appropriately performed. Alternatives (including equivalents, extensions, variations, deviations, etc., of those described herein) will be apparent to persons skilled in the relevant art(s) based on the teachings contained herein. Such alternatives fall within the scope and spirit of the disclosed embodiments.

It is intended that the disclosure and examples be considered as exemplary only, with a true scope and spirit of disclosed embodiments being indicated by the following claims.

What is claimed is:

1. A feeding network for base station antenna, comprising a multi-level feeding structure, wherein:

each level includes:

first and second phase shifters;

a 3-way power divider, including an input terminal for connecting to a feeding port, a first output terminal for feeding a first unit of the base station antenna, a second output terminal connecting to the first phase shifter, and a third output terminal connecting to the second phase shifter;

a first 2-way power divider, including an input terminal connecting to the first phase shifter, a first output terminal for feeding a second unit of the base station antenna, and a second output terminal for cascading a third phase shifter; and a second 2-way power divider, including an input terminal connecting to the second phase shifter, a first output terminal for feeding a third unit of the base station antenna, and a second output terminal for cascading a fourth phase shifter;

adjacent levels are connected to each other through tiling or laminating;

the 3-way power divider, the first and second 2-way power dividers, and the first and second phase shifters in a same level are all placed in an integrally formed metal housing;

the input terminal and the first output terminal of the 3-way power divider, the first output terminal of the first 2-way power divider, and the first output terminal of the second 2-way power divider are distributed along a same long side of the metal housing;

the 3-way power divider, the first 2-way power divider, and the second 2-way power divider in a same level all include an air strip line in branch form.

2. The feeding network of claim 1, wherein the first phase shifter in each level includes a fixed transmission line and a sliding transmission line.

3. The feeding network of claim 2, wherein the fixed transmission line in each level includes a hollow metal tube.

4. The feeding network of claim 2, wherein the sliding transmission line in each level includes a U-shape metal rod inserted into the fixed transmission line.

5. The feeding network of claim 4, wherein the U-shape metal rod in each level is coated with an insulation layer.

6. The feeding network of claim 1, wherein the shape of a cross section of the air strip line is selected from a group consisting of: a flat shape, a round shape, a square shape, and a combination of the above.

7. The feeding network of claim 1, wherein the shape of a cross section of the metal housing is selected from a group consisting of: a single rectangle, a one-side-opened single rectangle, an up-down dual rectangle, an up-down one-side-opened dual rectangle, a left-right dual rectangle, a left-right one-side-opened dual rectangle, and a multi-cavity structure formed by combining two or more of the above.

8. The feeding network of claim 1, wherein the first and second phase shifters in a same level are configured to apply an equal-difference phase change.

9. The feeding network of claim 1, wherein at least one of the first or second phase shifter in a same level is configured to perform phase shifting by adjusting an electrical length of a transmission line.

* * * * *